US005211308A

United States Patent [19]

Decker et al.

[11] Patent Number: 5,211,308

[45] Date of Patent: May 18, 1993

[54] UNIVERSAL FUNNEL FOR A PAPER DISPENSER

[75] Inventors: Joseph A. Decker; David Pecoraro, both of Houston, Tex.

[73] Assignee: NYCO International, Inc., Houston, Tex.

[21] Appl. No.: 842,476

[22] Filed: Feb. 27, 1992

[51] Int. Cl.[5] ..... B65H 1/00

[52] U.S. Cl. ..... 221/63; 221/303

[58] Field of Search ..... 221/303, 63, 44, 33, 221/45, 46, 106; 242/55.18, 55.19 R

[56] References Cited

U.S. PATENT DOCUMENTS

| | | | |
|---|---|---|---|
| 1,151,064 | 8/1915 | Swift | 221/63 |
| 1,513,792 | 11/1924 | Arelt | 221/63 |
| 3,982,659 | 9/1976 | Ross | 221/63 |
| 4,905,868 | 3/1990 | Beane et al. | 221/44 |
| 4,930,385 | 6/1990 | Wilfong, Jr. et al. | 221/63 |

*Primary Examiner*—Robert P. Olszewski

*Assistant Examiner*—Kenneth Noland

*Attorney, Agent, or Firm*—Leydig, Voit & Mayer

[57] ABSTRACT

Paper is unwound from the inside diameter of a tubular roll of paper in a dispensing container, is threaded downwardly through a dispensing funnel installed in a hole in the bottom wall of the container, and is adapted to be pulled downwardly from the funnel and torn into individual hand wipers. The funnel is formed with three dispensing ports of different sizes to accommodate paper of different thicknesses and includes an angled lower end portion which promotes reliable tearing of the paper and causes a tail of predetermined length to be left extending from the funnel for use in the next dispensing operation. The angled lower end portion of the funnel may be pointed forwardly if the dispenser is mounted at a relatively high elevation and may be pointed rearwardly if the dispenser is mounted at a relatively low location. The funnel may be installed securely in holes of different diameters and used with bottom walls of different thicknesses.

17 Claims, 3 Drawing Sheets

Fig. 3.
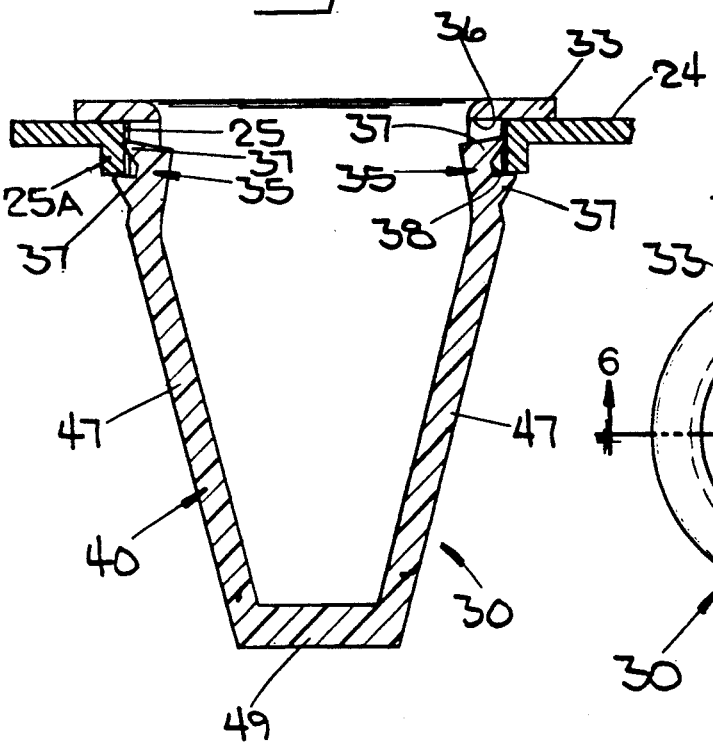
Fig. 4.
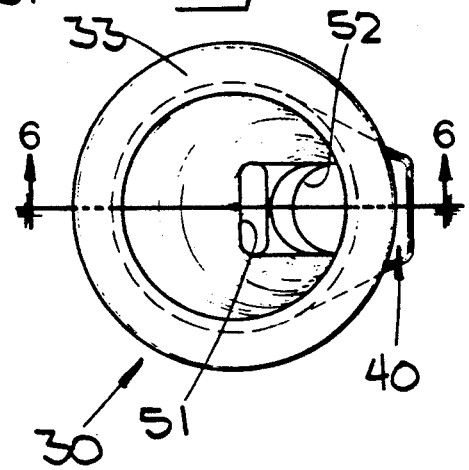
Fig. 5.
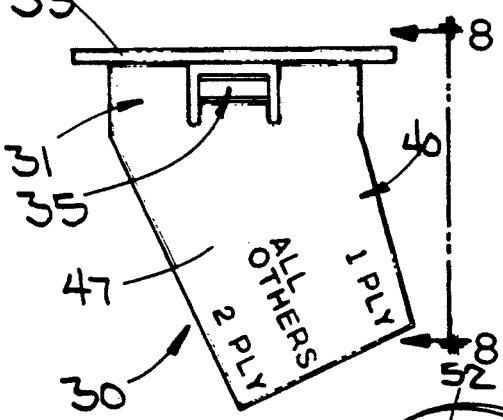
Fig. 6.
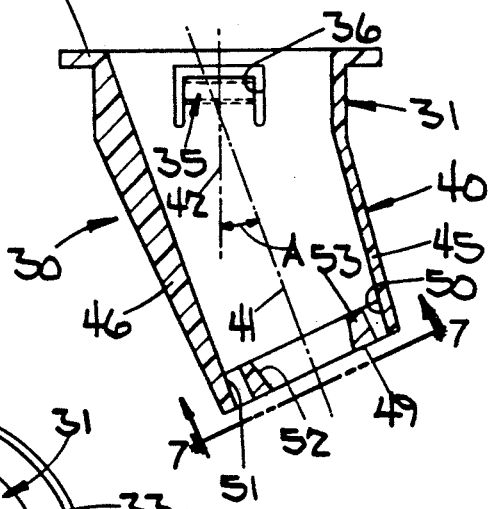
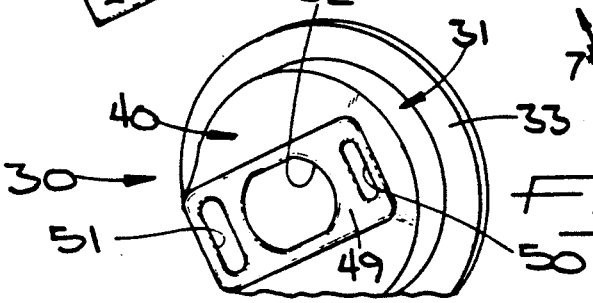
Fig. 7.

33
31
37
45
37
35
35
47
50
47
40
30
52
49
51

21
31
46
45
53
54
50
30
40
52
51

35
21
31
36
30
53
50
40
54
51

26
21
20
28
45
40
23
46
30
52
54

33
37
37
35
35
37
25'
38
37
30
40

UNIVERSAL FUNNEL FOR A PAPER DISPENSER

BACKGROUND OF THE INVENTION

This invention relates generally to a paper dispenser of the type in which a tubular roll of paper is supported in an upright position in a wall-mounted container having an opening in the bottom wall thereof. The leading or free end portion of the paper is threaded through a dispensing funnel fixed within the opening and extending downwardly from the bottom wall of the container.

Dispensing of the paper is effected by pulling downwardly on the free end portion of the paper to cause the paper to unwind from the inner diameter of the roll and to advance downwardly through the funnel. The paper usually is perforated at spaced increments along its length and, as the paper is pulled downwardly, the funnel causes a wiper or towel of predetermined length to be torn away from the remainder of paper on the roll. A short length of paper (i.e., a "tail") is left exposed beneath the funnel and may be pulled to effect dispensing of the next wiper.

With presently existing funnels, difficulty is encountered in dispensing paper of different thicknesses. If the dispensing port of the funnel is sized to accommodate relatively light paper, thicker paper tends to bunch in the funnel and does not flow easily out of the funnel when pulled. If the funnel is designed with a larger dispensing port for thick paper, lighter paper flows from the funnel with such little resistance that tearing of the paper into individual wipers is not reliably achieved.

Conventional funnels also do not lend themselves to use with dispensers which are mounted at widely varying heights on the wall. A funnel which is designed for use with a dispenser mounted relatively high on the wall does not function well with a low-mounted dispenser and, conversely, a funnel for a low-mounted dispenser is not adaptable to a high-mounted dispenser. Conventional funnels also are not readily installable in dispensing containers having differently sized openings in their bottom walls or having bottom walls of different thicknesses or materials.

SUMMARY OF THE INVENTION

The general aim of the present invention is to provide a paper dispensing funnel which may be used universally with papers of different thicknesses, with dispensers mounted at a wide range of heights, and with dispensers having different bottom openings for the funnel.

A more detailed object of the invention is to achieve the foregoing through the provision of a funnel having multiple dispensing ports of different sizes for paper of different thicknesses and having a uniquely angled lower end portion which enables consistently reliable dispensing of the paper regardless of the mounting height of the dispenser.

An important object of the invention is to provide a dispensing funnel in which a freely rotatable ball at the lower end of the funnel aids in the flow of paper out of the funnel while in some cases imparting resistance to the paper to promote reliable tearing of the paper into individual wipers.

The invention also resides in the provision of unique latching ears which enable the funnel to be securely installed in openings of different diameters and in bottom walls of different thicknesses.

These and other objects and advantages of the invention will become more apparent from the following detailed description when taken in conjunction with the accompanying drawings.

BRIEF DESCRIPTION OF THE DRAWINGS

FIG. 3 is an enlarged fragmentary cross-section taken substantially along the line 3—3 of FIG. 1.

FIG. 4 is a top plan view of the funnel.

FIG. 5 is a side elevational view of the funnel.

FIG. 6 is a cross-section taken substantially along the line 6—6 of FIG. 4.

FIG. 7 is a bottom view of the funnel as seen substantially along the line 7—7 of FIG. 6.

DETAILED DESCRIPTION OF THE PREFERRED EMBODIMENT

Figure 1:
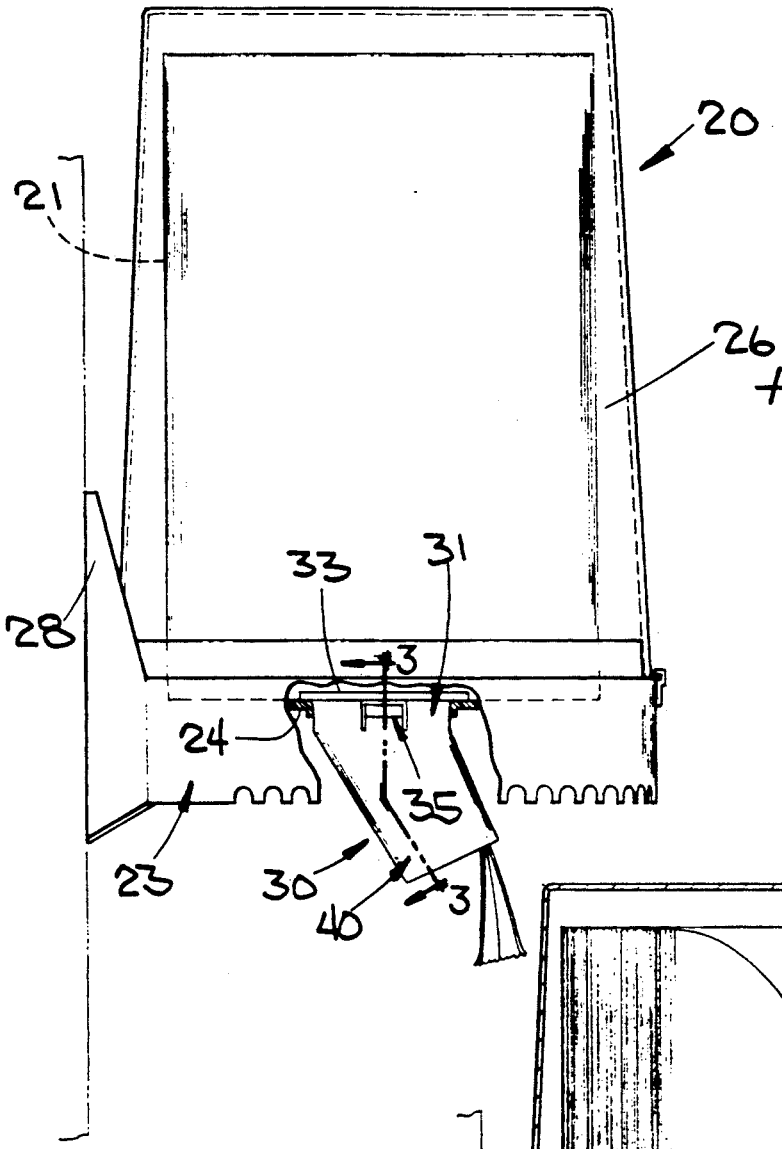
FIG. 1 is a side elevational view of a typical paper dispenser equipped with a new and improved dispensing funnel incorporating the unique features of the present invention, certain parts of the dispenser being broken away and shown in section in order to better illustrate the funnel.

For purposes of illustration, the invention has been shown in the drawings as embodied in a dispenser 20 for holding an upright tubular roll 21 of paper and for enabling the paper to be pulled downwardly from the dispenser and torn into individual sheets of predetermined length. The sheets may, for example, be used as hand towels or wipers.

Figure 2:
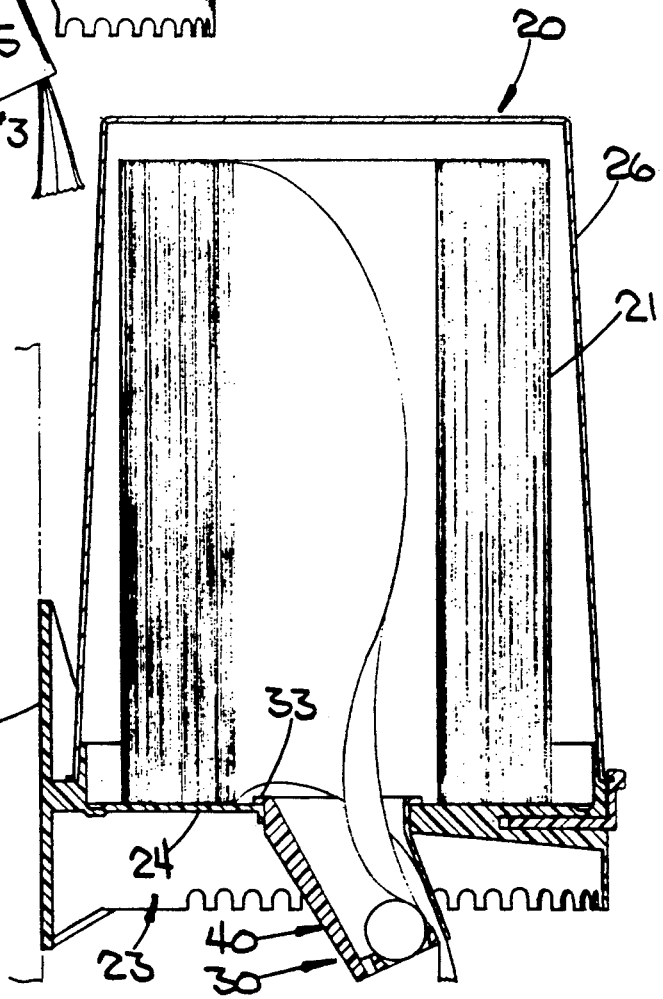
FIG. 2 is a cross-sectional view taken axially through the dispenser and funnel shown in FIG. 1.

In this particular instance, the tubular roll 21 of paper is wound such that a leading end portion of paper unwinds from the inner diameter of the roll as shown in FIG. 2 as the leading end portion is pulled downwardly. The paper preferably is formed with laterally extending rows of perforations spaced at predetermined increments along the length of the paper in order to facilitate tearing of the paper into individual wipers having a length of, for example, 13" or 15¾".

For the most part, the dispenser 20 is of conventional construction and comprises a container formed in 20 part by a base 23 (FIG. 2) having a generally horizontal bottom wall 23 with a vertically extending opening or hole 25 (FIG. 3) therethrough. The roll 21 is supported on the upper side of the bottom wall 24 in concentric relation with the hole 25. A transparent plastic cover 26 (FIGS. 1 and 2) is attached removably to the base 23 and encloses the roll 21.

Formed integrally with the rear side of the base 23 is a mounting bracket 28 (FIGS. 1 and 2) which may be used to attach the dispenser 20 to the wall of a restroom or the like. In most instances, the lower end of the base is located at a height of 40 or more inches above the floor in order to enable convenient access to the dispenser and in order to enable a trash container to be located below the dispenser.

Paper unwound from the inner diameter of the roll 21 threads downwardly through a dispensing funnel 30 which guides the paper and imparts some resistance thereto in order to promote tearing of the paper into individual wipers. The funnel is located within the hole 25 in the bottom wall 24 of the base 2 and extends downwardly from the bottom wall.

In accordance with the present invention, the funnel 30 is uniquely constructed to accommodate different types of papers of widely varying thicknesses, to enable the dispenser 20 to function effectively regardless of the mounting height of the dispenser above the floor, and to enable the funnel to be installed in dispensers having holes 25 of different sizes in their bottom walls 24. As a result, a single funnel may be used universally in a wide variety of applications so as to avoid the need of providing a customized funnel for each different application.

More specifically, the present funnel 30 preferably is of low cost, single-piece construction and preferably is injection molded from a relatively rigid but resiliently yieldable and high lubricity plastic such as that sold under the trade designator "Zytel". The funnel includes a generally cylindrical upper end portion 31 located within the hole 25 in the bottom wall 24, the hole shown in FIG. 3 in part being defined by an annular collar 25A depending from the bottom wall. An annular flange 33 is formed integrally with and projects radially outwardly from the upper end of the cylindrical upper portion 31 of the funnel 30 and engages the upper side of the bottom wall 24 to prevent the funnel from being pulled downwardly through the hole 25.

Pursuant to one aspect of the invention, two diametrically spaced latching ears 35 are formed integrally with the cylindrical portion 31 of the funnel 30 and prevent the funnel from moving upwardly within the hole 25. Herein, each latching ear is located within a window 36 (FIG. 6) formed through the cylindrical portion 31 and is integrally hinged to the lower edge of the window to swing inwardly and outwardly. In the relaxed condition of the plastic, two vertically spaced lugs 37 (FIG. 3) which are formed integrally with each ear 35 project radially outwardly from the outer surface of the cylindrical portion 31, the ears being separated by an annular groove 38. When the funnel 30 is thrust downwardly through the hole 25 during assembly of the funnel, each ear 35 is cammed inwardly and, when the lower lug 37 of the ear clears the lower end of the collar 25A, the ear springs outwardly to cause the lower end of the collar to be received in the groove 38 and to engage the upper side of the lower lug thereby to captivate the funnel against upward movement within the hole. Thus, the funnel is assembled with the bottom wall 24 with a snap fit.

In carrying out the primary aspect of the invention, the funnel 30 includes a lower end portion 40 which extends downwardly from the cylindrical upper end portion 31 at a predetermined angle A (FIG. 6). The lower end portion 40 of the funnel includes a longitudinal centerline 41 which is inclined relative to the axis 42 of the upper cylindrical portion 31 at the angle A, which herein is approximately 25 degrees. When the dispenser is mounted 40 or more inches above floor level, the funnel is oriented angularly such that the angled lower end portion 40 points forwardly and progresses forwardly upon proceeding downwardly.

The lower end portion 40 of the funnel 30 is defined by front and rear walls 45 and 46 (FIG. 6) and by two laterally spaced side walls 47 (FIG. 3). The outer sides of the front and rear walls 45 and 46 are generally flat and planar and extend generally parallel to one another. The outer sides of the two side walls 47 converge toward one another as they progress downwardly (see FIG. 3) and are somewhat curved so as to merge gradually with the front and rear walls and with the upper cylindrical portion 31. As shown most clearly in FIG. 4, the interior of the funnel is smooth and gradually tapers from a circular configuration to a generally rectangular configuration upon progressing downwardly.

The lower end of the lower end portion 40 of the funnel 30 is formed with a bottom 49 (FIGS. 6 and 7) whose lower surface is disposed in a plane which is substantially perpendicular to the longitudinal centerline 41 of the lower end portion. Formed through the bottom 49 is a series of spaced dispensing ports for receiving paper of different thicknesses, there herein being three dispensing ports 50, 51 and 52. The ports 50 and 51 are generally elliptical in shape with the major and minor axes of the port 50 being smaller than the major and minor axes, respectively, of the port 51. Light and heavy weight single ply paper is adapted to be threaded through the port 50 while light and heavy weight double ply paper is adapted to be threaded through the port 51. The dispensing port 52 is located between and is significantly larger than the ports 50 and 51 and is adapted to receive other types of paper such as light and heavy weight airlay paper, scrim, and carded web. The front and rear edges of the center port 52 are arcuate while the side edges of the center port are straight and parallel, the port thus being somewhat circular in cross-section.

Figures 8, 9, 10, 11, 12:
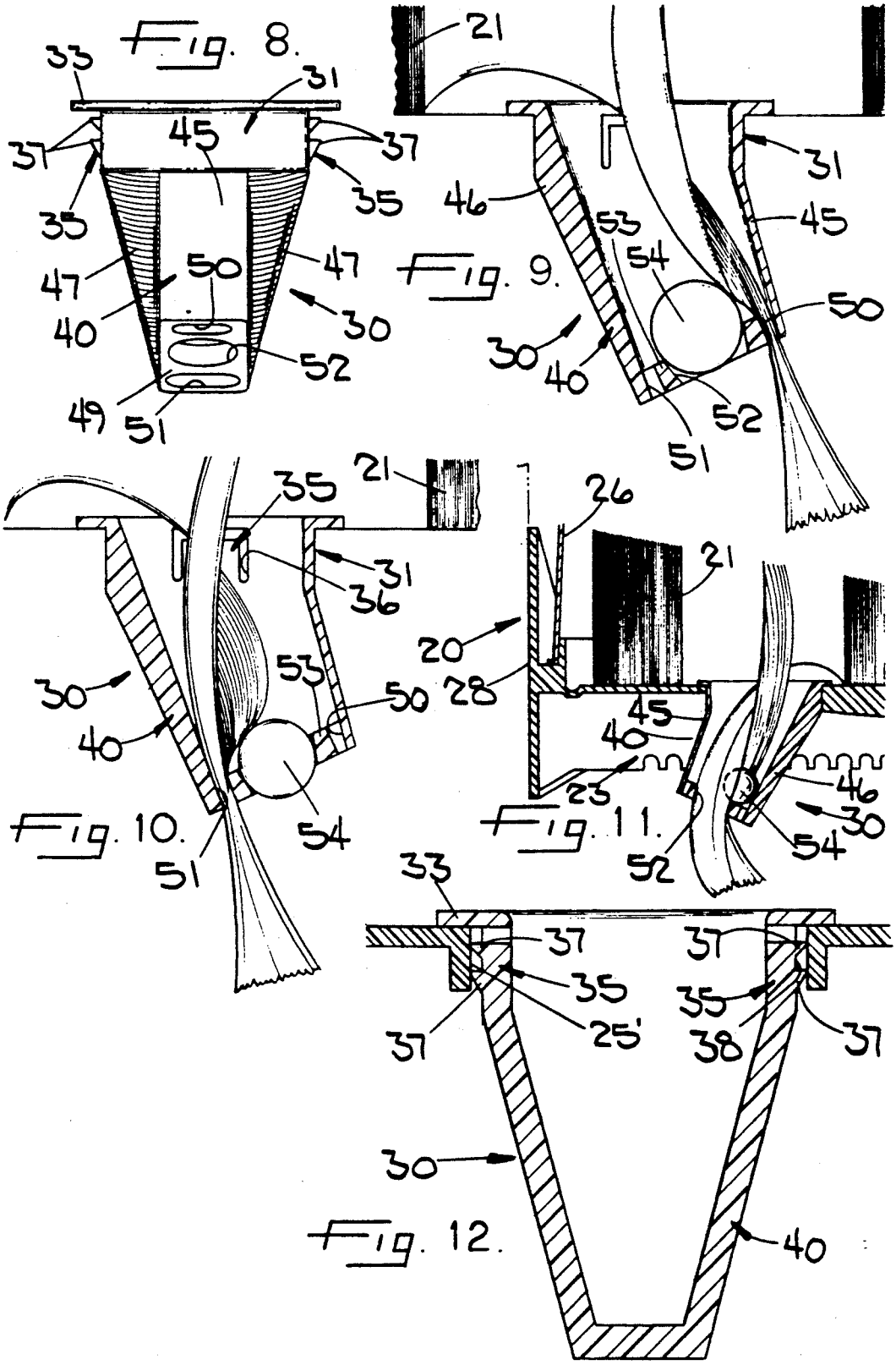
FIG. 8 is a front elevational view of the funnel as seen substantially along the line 8—8 of FIG. 5.
FIG. 9 is an enlarged view of the funnel illustrated in FIG. 2 and shows the paper threaded through one of the dispensing ports.
FIG. 10 is a view similar to FIG. 9 but shows the paper threaded through another one of the dispensing ports.
FIG. 11 is a fragmentary view similar to FIG. 2 but shows the paper threaded through yet another dispensing port and shows the funnel as being turned to function with a relatively low-mounted dispenser.
FIG. 12 is a view similar to FIG. 3 but shows the funnel mounted in a differently sized opening in the bottom wall of the dispenser.

The center port 52 also defines a generally frustoconical seat 53 for a plastic spherical ball 54 (FIG. 9). As shown in FIGS. 6 and 9, the seat tapers upon progressing downwardly and generally retains the ball while allowing the ball to spin freely.

FIGS. 1, 2 and 9 show a high-mounted dispenser 20 which is set up to dispense single ply paper. As illustrated, the funnel 30 is oriented such that the angled lower end portion 40 thereof points downwardly and forwardly. The leading end portion of the paper from the roll 21 is threaded through the front dispensing port 50, which is the smallest of the three ports 50, 51 and 52. The ball 54 is located in the ball seat 53 and lightly engages the rear side of the leading end portion of the paper. When the free end of the paper is pulled downwardly, the ball spins to reduce friction against the paper and assist the paper in moving through the dispensing port 50. The dispensing port imparts resistance against the paper and, as more paper is pulled downwardly and the arc of the person's arm changes, the resistance together with the angle of the lower end portion 40 of the funnel 30 causes a wiper to tear away from the paper along the perforations and to leave a tail of about 1½" in length extending downwardly from the funnel. The tail is grabbed and pulled during dispensing of the next wiper.

In FIG. 10, the dispenser is set up the same as in FIGS. 1, 2 and 9 except that the paper is two ply paper and is threaded through the rear dispensing port 51. The larger port 51 accommodates the thicker paper and, during dispensing thereof, the ball 54 rides against the forward side of the paper to assist in the flow of the paper. The size of the dispensing port 51 along with the length and the angle of the lower end portion 40 of the funnel causes the paper to tear such that a tail approximately 1½" in length is left hanging from the funnel for use in the next dispensing operation.

FIG. 11 shows the dispenser 20 mounted at a relatively low elevation (e.g., less than 40" above the floor) and shows scrim or the like threaded through the large center port 52. In this instance, the funnel 30 is turned through 180 degrees and is oriented such that the angled lower end portion 40 points toward the rear and progresses rearwardly upon proceeding downwardly. The ball 54 is crowded out of the ball seat 53 by the paper but is lodged between the paper and the wall 46 of the funnel to partially fill the port and impart resistance to the paper. This assists in tearing of the paper while leaving a 1½" tail extending from the funnel. By virtue of the funnel being turned such that the angled lower end portion points rearwardly, the funnel compensates for the arc in a person's arm in first pulling the paper downwardly and then upwardly from the low-mounted dispenser and enables reliable tearing of the paper at the perforations while leaving a 1½" tail hanging from the funnel.

It has been found advantageous to use a smaller ball 54 when the lower end portion 40 of the funnel 30 points toward the rear than when the lower end portion points toward the front. By way of example, a ball which is ⅝" in diameter may be used with a rearwardly pointing lower end portion while a ball with a diameter of ¾" may be used when the lower end portion points forwardly.

The funnel 30 shown in FIG. 3 is installed in a bottom wall 24 having a hole 25 of relatively small diameter. If the hole is somewhat larger, the funnel may be installed as shown in FIG. 12 in which both lugs 37 of the latching ears 35 are received within a larger hole 25' with a tight press fit. The lugs also allow installation of the funnel in bottom walls having different thicknesses. If the wall is relatively thin, the upper side of the upper lug 37 may engage the underside of the wall to hold the funnel securely in place.

From the foregoing, it will be apparent that the present invention brings to the art a new and improved dispensing funnel 30 which may be used universally with paper of widely varying thicknesses, with dispensers 20 mounted at either high or low elevations and with dispensers having bottom walls 24 of various thickness and having holes 25 of various diameters. The funnel itself is of relatively low cost one-piece molded plastic construction and, because it may be used universally in so many different applications, it eliminates the cost of manufacturing, stocking and selling customized funnels.

We claim:

1. A funnel for dispensing paper, said funnel comprising a one-piece tubular body molded of plastic and having a substantially vertically extending upper end portion, said body having a lower end portion extending downwardly from and inclined at a predetermined angle relative to said upper end portion, said lower end portion having a bottom, a pair of spaced paper dispensing ports extending through the bottom of said lower end portion, said ports being of different sizes to accommodate paper of different thicknesses, a ball seat formed in said bottom between said ports, and a generally spherical ball located within said lower end portion and supported to spin in said ball seat.

2. A funnel as defined in claim 1 in which said ports are generally elliptical, the major and minor axes of one of said ports being larger than the major and minor axes, respectively, of the other of said ports.

3. A funnel as defined in claim 2 in which said ball seat is defined by a hole formed through said bottom wall and having a generally circular cross-section, the diameter of said hole being significantly larger than the minor axes of said ports.

4. A funnel as defined in claim 3 in which said hole is generally frustoconical in shape and tapers upon progressing downwardly.

5. A funnel as defined in claim 1 in which the lower end portion of said body is defined by generally parallel front and rear walls and by a pair of spaced side walls extending between said front and rear walls, said side walls converging toward one another upon progressing downwardly.

6. A funnel as defined in claim 1 further including an annular flange formed integrally with and extending radially outwardly from the upper end of the upper end portion of said body, and a pair of angularly spaced latching ears formed integrally with said body and located below said flange, said ears projecting radially outwardly from the outer surface of the upper portion of said body and being integrally hinged to said body to flex inwardly relative to said outer surface.

7. A funnel as defined in claim 6 in which each of said latching ears is formed with an annular groove located between the upper and lower ends of the ear.

8. A funnel for dispensing paper, said funnel comprising a one-piece tubular body molded of plastic and having a generally cylindrical upper end portion, said upper end portion having a substantially vertically extending axis, said body having a lower end portion with a longitudinal centerline, said lower end portion extending downwardly from said upper end portion and being oriented such that the longitudinal centerline of said lower end portion is inclined at an angle of about twenty-five degrees relative to the axis of said upper end portion, said lower end portion having a bottom with a lower surface disposed in a plane substantially perpendicular to said longitudinal centerline, and a pair of spaced paper dispensing ports formed through the bottom of said lower end portion, said ports being of different sizes to accommodate paper of different thicknesses.

9. A funnel as defined in claim 8 further including a ball seat formed in said bottom between said ports, and a generally spherical ball located to spin within said ball seat.

10. A dispenser for a tubular roll of paper having a leading end portion adapted to be pulled downwardly and unwound from the inner diameter of the roll, said dispenser comprising a container having a front side and having a generally horizontal bottom wall of predetermined thickness for supporting the roll in an upright position, a hole formed vertically through said bottom wall and generally concentric with the inner diameter of the roll, and a dispensing funnel fixed within said hole for guiding said paper from said container and for facilitating tearing of the leading end portion of the roll from the remainder of the roll, said funnel comprising a one-piece tubular body made of plastic and having a generally cylindrical upper end portion located within said hole, said upper end portion having a substantially vertically extending axis, an annular flange formed integrally with and extending radially outwardly from the upper end of said upper portion and engaging the upper side of said bottom wall to prevent said funnel from moving downwardly within said hole, angularly spaced ears formed integrally with said body below said flange and engaging said bottom wall to prevent said funnel from moving upwardly within said hole, said body having a lower end portion with a longitudinal centerline, said lower end portion extending downwardly from said upper end portion and being oriented such that the longitudinal centerline of said lower end portion is inclined at a predetermined acute angle relative to the axis of said upper end portion, said lower end portion having a bottom with a lower surface located in non-perpendicular relation to said axis, front and rear paper dispensing ports extending through and spaced along the bottom of said lower end portion, said ports being of different sizes to accommodate paper of different thicknesses, the leading end portion of said paper being threaded through one of said ports, a ball seat formed in the bottom of said lower end portion between said ports, and a generally spherical ball located inside of said lower end portion and supported to spin in said ball seat to facilitate the flow of paper through said one port.

11. A dispenser as defined in claim 10 in which said funnel is oriented angularly in said hole such that the lower end portion of the funnel progresses forwardly upon proceeding downwardly.

12. A dispenser as defined in claim 10 in which said funnel is oriented angularly in said hole such that the lower end portion of said funnel progresses rearwardly upon proceeding downwardly.

13. A dispenser as defined in claim 10 in which said ears project radially outwardly from the outer surface of the upper portion of said body and are integrally hinged to said body to flex inwardly relative to said outer surface.

14. A dispenser as defined in claim 13 in which each of said ears is formed with an annular groove located between the upper and lower ends of the ear, said bottom wall having an edge portion located adjacent said hole and received in said groove.

15. A dispenser as defined in claim 13 in which each of said ears is formed with an annular groove located between the upper and lower ends of the ear, said ears being received within said hole in said bottom wall with a press fit.

16. A dispenser as defined in claim 10 in which the lower end portion of said body is defined by generally parallel front and rear walls and by a pair of spaced side walls extending between said front and rear walls, said side walls converging toward one another upon progressing downwardly.

17. A dispenser as defined in claim 10 in which the lower surface of the bottom of said lower end portion is disposed substantially perpendicular to the longitudinal centerline of said lower end portion.

* * * * *